United States Patent [19]

Hartmann et al.

[11] 4,402,899

[45] Sep. 6, 1983

[54] ZINC-FREE PREPARATION OF RAYON FIBERS

[75] Inventors: Peter J. Hartmann, Dover; Albin F. Turbak, Convent Station, both of N.J.

[73] Assignee: International Telephone and Telegraph Corporation, New York, N.Y.

[21] Appl. No.: 283,069

[22] Filed: Jul. 13, 1981

[51] Int. Cl.[3] ..... D01F 2/06

[52] U.S. Cl. ..... 264/188; 264/197

[58] Field of Search ..... 264/188–197

[56] References Cited

U.S. PATENT DOCUMENTS

| | | | |
|---|---|---|---|
| 1,930,803 | 10/1933 | Harrison | 264/197 |
| 2,997,365 | 8/1961 | Smith et al. | 264/197 |
| 3,097,914 | 7/1963 | Lewis | 264/196 |
| 3,720,743 | 3/1973 | Stevens et al. | 264/188 |
| 4,242,405 | 12/1980 | Bockno | 264/188 |

*Primary Examiner*—Jay H. Woo

*Attorney, Agent, or Firm*—James B. Raden; Harold J. Holt

[57] ABSTRACT

Rayon fibers having a C-shaped cross section and characterized by low caustic solubility are prepared from an unmodified viscose spinning solution having a salt index below 14 by spinning the viscose solution into a zinc-free coagulation bath containing at least 100 g/l of $Na_2SO_4$, at least 175 g/l of $(NH_4)_2SO_4$ and more than 100 g/l of $H_2SO_4$ while the bath is at a temperature above 40° C. The coagulated filament is then stretched in a secondary bath maintained at a temperature over 70° C.

5 Claims, 8 Drawing Figures

ZINC-FREE PREPARATION OF RAYON FIBERS

This invention relates to a process for the zinc-free preparation of rayon fibers and to the fibers prepared therefrom.

Hollow fibers, or fibers whose crossectional shape approaches that of a hollow fiber, are desirable because their hiding power is greater than corresponding fibers which are solid. Hollow rayon fibers are today commercially available possessing such increased hiding power. However, the hollow fibers presently available have relatively high solubility in caustic and thus low resistance to a laundering.

Our copending application Ser. No. 283,070, filed concurrently herewith, discloses a zinc-free process for preparing rayon fibers of comparatively excellent properties. Such a process is of particular significance because zinc salts, universally used for the preparation of rayon fibers, present a particularly difficult pollution control problem. The fibers produced in accordance with the process of our copending application are generally kidney-beaned in crossectional shape.

It is an object of the present invention to provide a process for producing rayon fibers of increased hiding power having relatively low caustic solubility.

It is a further object of the present invention to provide a process for producing rayon fibers having a crossection approximating that of a nearly closed "C" by a zinc-free process.

It is an additional object of this invention to provide a rayon fiber having a C-shaped crossection, characterized by very low caustic solubility.

The foregoing rayon fibers are produced by preparing an unmodified viscose spinning solution from cellulose having a degree of polymerization of less than 650, the solution having a salt index below 14, and spinning the viscose solution into a zinc-free coagulation bath while said bath is at a temperature from about 40° to 100° C., said bath comprising at least 100 grams/liter of $Na_2SO_4$, at least 175 grams/liter of $(NH_4)_2SO_4$ and more than 100 grams/liter of $H_2SO_4$ when the salt index is no more than 10 and more than 110 grams/liter of $H_2SO_4$ when the salt index is above 10. The resulting coagulated filament is then stretched in a secondary bath while the secondary bath is at a temperature from about 70° to 100° C.

Figure 1:
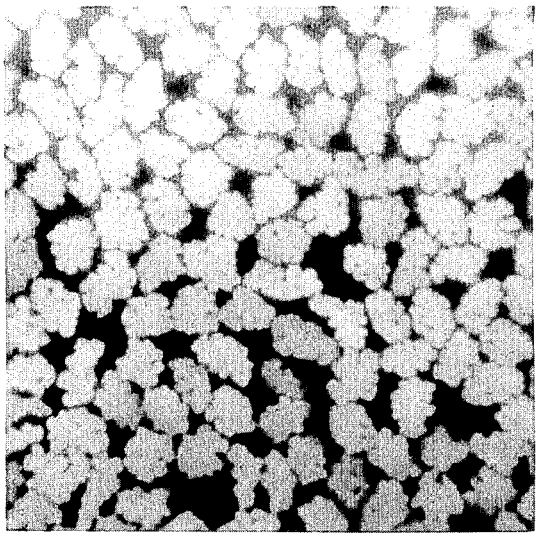
Figure 2:
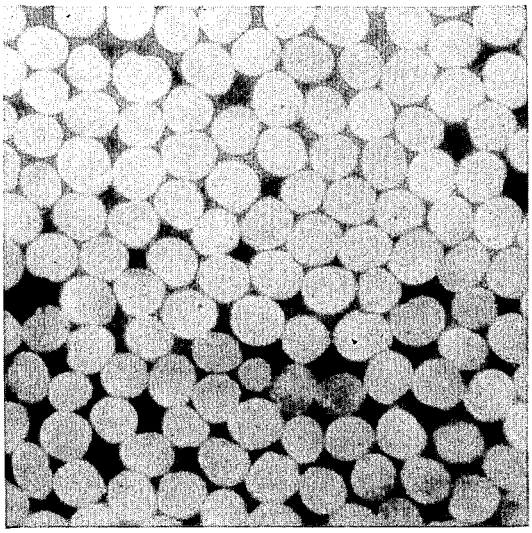

The invention will be better understood from the following description which should be considered together with the accompanying drawing in which FIGS. 1 and 2 are photomicrographs of the crossections of typical regular and high wet modulus rayon fibers produced in accordance with known prior art techniques, and FIGS. 3–8 are photomicrographs of the crossections of rayon fibers produced from zinc-free viscose processes varying essentially only the salt indexes and acid coagulation bath levels.

Ammonium sulfate has a water solubility of 440 g/l while sodium sulfate is saturated at 280 g/l at 25° C. Thus, ammonium sulfate baths of high concentrations are extremely good dehydrating agents and will remove water from any source, such as viscose dope. By using a coagulation bath of the foregoing selected high concentration salt mixture, high acid level and the required temperatures, we have been able to exert control of viscose coagulation relative to regeneration so as to be able to obtain rayon fibers of the desired C-shaped crossection having low caustic solubility ($S_{6.5}$) values without the use of either viscose additives or zinc salts in the coagulation bath. The fibers have wet modulus values of over 0.2 grams/denier and solubility in 6.5% caustic ($S_{6.5}$) values which are generally lower than regular rayon (20–30%).

The C-shaped fibers of the invention are generally produced in accordance with the zinc-free process disclosed in our aforesaid copending application Ser. No. 283,070 herein incorporated by reference, except that the acid and salt index levels are adjusted to ranges that lead to the desired "C" shape. Specifically, if the acid level of the coagulation bath is above 100 grams/liter, C-shaped fibers may be made with viscose salt indexes below 10, usually between 3 and 10. When the acid level of the coagulation bath is above 110 g/l, it is possible to make C-shaped fibers with very green viscoses, that is, viscoses having a salt index as high as 14. In the preferred practice of the invention, the salt index of the viscose is from 3 to 10, the amount of $Na_2SO_4$ in the coagulation bath is from 135 to 165 g/l and the amount of $(NH_4)_2SO_4$ is from 190 to 250 g/l. In addition, the secondary bath preferably has substantially the same composition as the first or primary bath.

Figure 3:
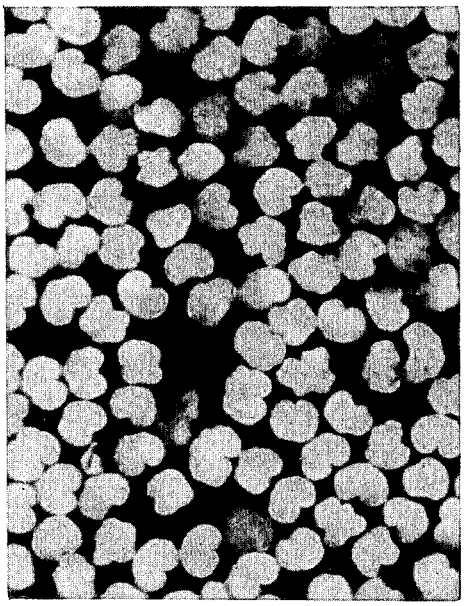
Figure 4:
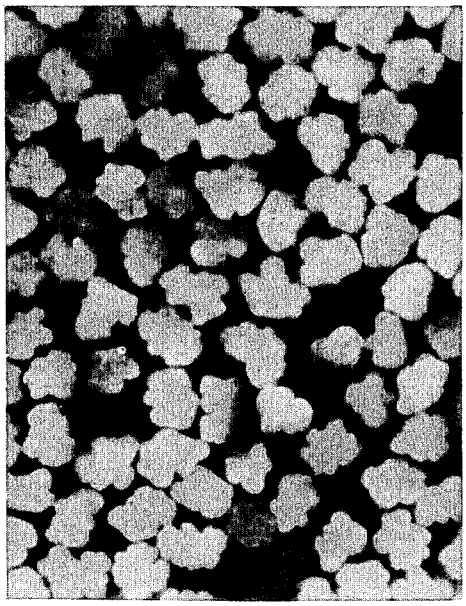

The invention is illustrated by the drawing in which FIGS. 1 and 2 are photomicrographs of fiber crossections of conventional rayon fibers. FIG. 1 is a regular rayon fiber exhibiting a typical crenulated crossection. FIG. 2 is a high wet modulus fiber exhibiting a typical round crossection. These conventional fiber crossections are shown to illustrate the difference between the present fiber crossection and those typical fibers of the prior art. FIGS. 3–8 are fibers prepared from high salt concentration zinc-free viscose processes in which the salt indexes and acid levels have been varied to illustrate the relationship of these parameters to fiber shape. In FIGS. 3 and 4, 50 g/l of acid was used in the coagulation baths; in FIGS. 5 and 6 100 g/l of acid was used, in FIGS. 7 and 8 113 g/l of acid was used. In each pair of tests, the salt index was varied from 8.8 to 14. Thus, the fibers of FIGS. 3, 5 and 7 were prepared from a viscose with a salt index of 8.8 whereas the fibers of FIGS. 4, 6 and 8 used a salt index of 14. At the low acid level of 50 g/l, it will be seen in FIGS. 3 and 4 that no C-shaped fibers were formed regardless of the salt index of the viscose. At the intermediate acid level of 102 g/l, the low salt index gave some C-shaped fibers (FIG. 5) while the high salt index gave none (FIG. 6). At the higher acid level of 113 g/l, both the low and high salt indexes gave C-shaped fibers (FIGS. 7 and 8), the low salt index giving C-shaped fibers of exceptional quality.

The foregoing illustrations demonstrate that when high salt baths (those containing high concentrations of sodium and ammonium sulfate) are used for preparing fibers, there is a direct relationship between the ripeness (or salt index) of the viscose, the acid level of the coagulation bath and the shape of the final fiber. Given a high level of acid (over 110 g/l), even high index or very green viscoses give C-shaped fibers. At somewhat lower coagulation acid levels of about 100 or more, the salt index must be maintained at a lower level of 10 or less. At acid levels less than 100 g/l, no C-shaped fibers are formed regardless of the salt index.

The invention will be better understood from the following examples in which all parts and percentages are by weight, unless otherwise indicated. In these examples, the pulp and NaOH are based on total composition weight, $CS_2$ is based on cellulose weight.

EXAMPLE 1

A viscose composition was prepared from 7.5% prehydrolyzed kraft cellulosic pulp, 7.5% NaOH and 30% $CS_2$. The viscose was mixed for two hours, filtered, vacuum deaerated and ripened for about 20 hours at ambient temperature. No modifiers of any type were added. The salt index was 8.8 at the time of spin. The viscose solution was then spun through an 1100 hole spinnerette having a hole size of 63.5 microns, employing the following conditions:

| | Primary Bath | Secondary Bath |
|---|---|---|
| $H_2SO_4$ (g/l) | 50 | 50 |
| $Na_2SO_4$ (g/l) | 150 | 150 |
| $(NH_4)_2SO_4$ (g/l) | 250 | 250 |
| Temperature (°C.) | 40-50 | 96 |
| Travel (m) | 0.69 | 0.74 |

Take-up speed of the fiber on the godet was 30 m/min. Stretch was 82%. Approximately 5 grams of fiber was collected on the take-up godet, removed, cut to staple length, washed with hot tap water and squeezed by hand. The fiber was then soaked in acetone for ten minutes, squeezed by hand and allowed to air dry in a fume hood overnight. Fiber properties were then measured.

EXAMPLES 2-6

Example 1 was repeated except that the salt index of the viscose and the acid level of the primary coagulation bath were altered to various levels both within and outside the scope of the invention. In all cases, the viscose contained 7.5% cellulosic pulp, 7.5% NaOH and 30% $CS_2$. The specific compositions of the viscoses and coagulation baths of Examples 1-6 and the properties of the resulting fibers are set forth in the following table.

TABLE

| Example | 1 | 2 | 3 | 4 | 5 | 6 |
|---|---|---|---|---|---|---|
| Viscose | | | | | | |
| Added $CS_2$ ml/l | — | 4 | — | 4 | — | 4 |
| Salt Index | 8.8 | 14 | 8.8 | 14 | 8.8 | 14 |
| Primary Bath | | | | | | |
| $H_2SO_4$ g/l | 50 | 50 | 102 | 102 | 113 | 113 |
| $Na_2SO_4$ g/l | 150 | 150 | 135 | 135 | 150 | 150 |
| $(NH_4)_2SO_4$ g/l | 250 | 250 | 225 | 225 | 250 | 250 |
| Temp. °C. | 40-50 | 40-50 | 40-50 | 40-50 | 40-50 | 40-50 |
| Secondary Bath | | | | | | |
| $H_2SO_4$ g/l | 50 | 50 | 102 | 102 | 120 | 120 |
| $Na_2SO_4$ g/l | 150 | 150 | 150 | 150 | 150 | 150 |
| $(NH_4)SO_4$ g/l | 250 | 250 | 250 | 250 | 250 | 250 |
| Temp. °C. | 96 | 96 | 96 | 96 | 96 | 96 |

TABLE-continued

| Example | 1 | 2 | 3 | 4 | 5 | 6 |
|---|---|---|---|---|---|---|
| Properties | | | | | | |
| Denier d | 1.56 | 1.68 | 2.64 | 1.64 | 1.91 | 1.57 |
| Cond. ten. g/d | 2.31 | 2.10 | 2.33 | 1.90 | 2.74 | 2.53 |
| Cond. elong. % | 8.16 | 10.25 | 11.84 | 13.09 | 14.26 | 14.61 |
| Wet ten. g/d | 1.45 | 1.34 | 1.34 | 1.28 | 1.47 | 1.75 |
| Wet elong. % | 9.98 | 13.65 | 13.43 | 13.47 | 17.75 | 17.86 |
| Wet modulus g/d | 0.46 | 0.21 | 0.39 | 0.27 | 0.33 | 0.24 |
| Water reten. % | 95 | 105 | 105 | 136 | 93 | 124 |
| $S_{6.5}$ % | 8.5 | 15.1 | 15.6 | 18.3 | 8.5 | 20.2 |
| I. V. | 3.22 | 3.22 | 3.22 | 3.15 | 3.18 | 3.13 |
| D. P. | 529 | 529 | 529 | 515 | 521 | 511 |

Figure 5:
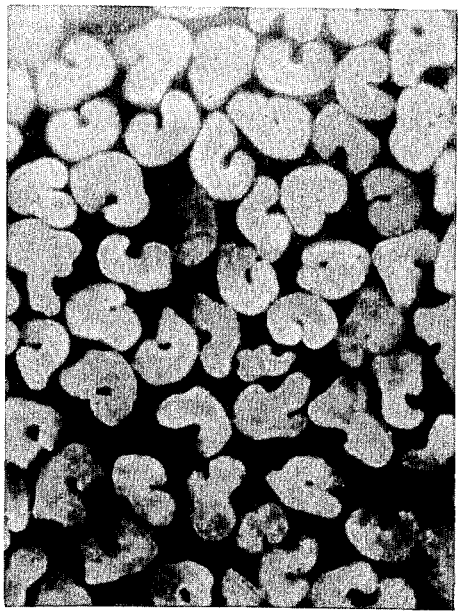
Figure 6:
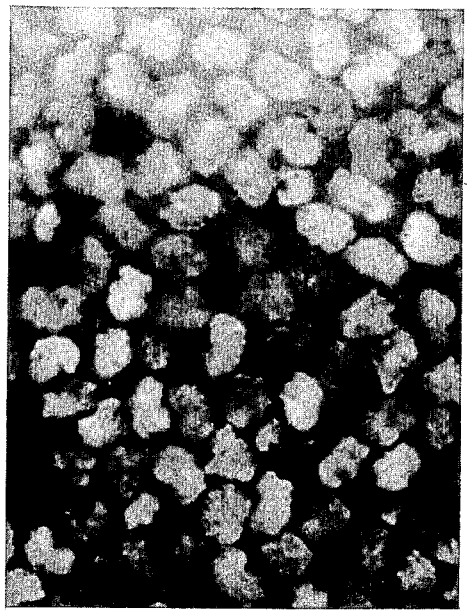
Figure 7:
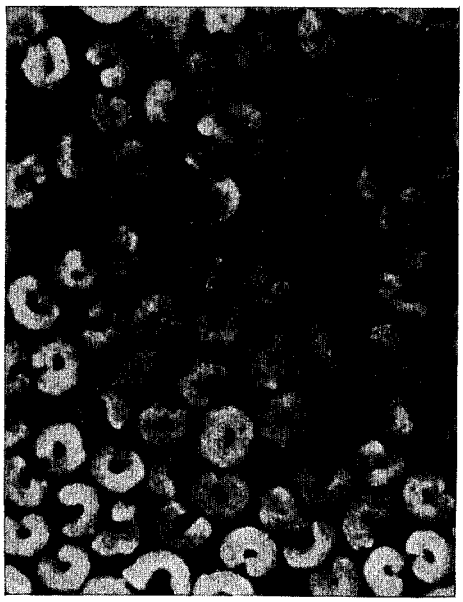
Figure 8:
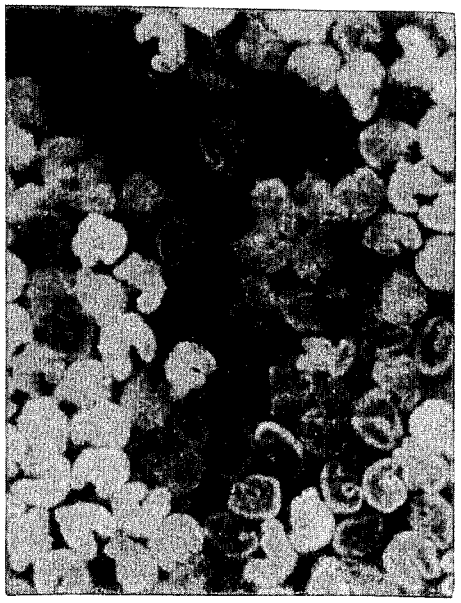

The fibers of Examples 1-6 are shown in the drawing in FIGS. 3-8 respectively. Examples 1, 2 and 4 and the corresponding fibers of FIGS. 3, 4 and 6 are outside the scope of the invention. Examples 3, 5 and 6 and FIGS. 5, 7 and 8 are illustrative of the process and the resulting fiber products of the invention.

The process of the invention thus produces rayon fibers having a crossection approximating that of a nearly closed "C" and possessing excellent hiding power. In addition, the fibers possess relatively high wet modulus and low caustic solubility properties. The process itself uses neither modifiers nor zinc and accordingly involves reduced environmental problems.

We claim:

1. A process for producing rayon fibers having a C-shaped crossection, a wet modulus of more than 0.2 g/d and a caustic solubility in 6.5% caustic of less than 30% comprising preparing an unmodified viscose spinning solution from cellulose having a degree of polymerization of less than 650, said solution having a salt index of below 14, spinning said viscose solution into a zinc-free coagulation bath while said bath is at a temperature from about 40° to 100° C., said bath comprising at least 100 g/l of $Na_2SO_4$, at least 175 g/l of $(NH_4)_2SO_4$ and more than 100 g/l of $H_2SO_4$ when said salt index is no more than 10 and more than 110 g/l of $H_2SO_4$ when said salt index is above 10 and stretching the resulting coagulated filament in a secondary bath while said secondary bath is at a temperature from about 70° to 100° C.

2. The process of claim 1 in which the salt index of the viscose is from 3 to 10.

3. The process of claim 1 in which the coagulation bath contains more than 110 g/l of $H_2S_4$.

4. The process of claim 1 in which the secondary bath has substantially the same composition as the coagulation bath.

5. The process of claim 1 in which the amount of $Na_2SO_4$ is from 135 to 165 g/l and the amount of $(NH_4)_2SO_4$ is from 190 to 250 g/l.

* * * * *